US006631808B2

(12) United States Patent
Sparks

(10) Patent No.: US 6,631,808 B2
(45) Date of Patent: Oct. 14, 2003

(54) AIR CLASSIFIER SYSTEM FOR THE SEPARATION OF PARTICLES

(75) Inventor: Robert E. Sparks, Kirkwood, MO (US)

(73) Assignee: Particle and Coating Technologies, Inc., St. Louis, MO (US)

( * ) Notice: Subject to any disclaimer, the term of this patent is extended or adjusted under 35 U.S.C. 154(b) by 0 days.

(21) Appl. No.: 09/922,868

(22) Filed: Aug. 7, 2001

(65) Prior Publication Data

US 2003/0057138 A1 Mar. 27, 2003

(51) Int. Cl.[7] ..... B07B 9/00

(52) U.S. Cl. ..... 209/33; 209/135; 209/138; 209/142; 209/380

(58) Field of Search ..... 209/21, 32, 33, 209/133, 134, 135, 142, 379, 380, 138

(56) References Cited

U.S. PATENT DOCUMENTS

| | | | | | |
|---|---|---|---|---|---|
| 1,420,593 | A | | 6/1922 | Titchmarsh | 209/135 |
| 2,751,079 | A | * | 6/1956 | Ahlmann | 209/380 X |
| 3,312,403 | A | | 4/1967 | Zifferer | 241/24.12 |
| 3,385,436 | A | | 5/1968 | Murphy | 209/142 X |
| 3,764,078 | A | | 10/1973 | Richard | 241/40 |
| 3,863,847 | A | | 2/1975 | Day et al. | 241/14 |
| 3,933,626 | A | | 1/1976 | Stukel et al. | 209/142 X |
| 3,979,073 | A | | 9/1976 | Leliaert | 241/5 |
| 4,039,625 | A | | 8/1977 | Davis | 241/14 X |
| 4,050,635 | A | | 9/1977 | Mueller et al. | 241/24 |
| 4,115,985 | A | | 9/1978 | Venot | 57/34 HS |
| 4,137,675 | A | | 2/1979 | Cina et al. | 209/291 X |
| 4,154,894 | A | | 5/1979 | Bushey | 428/404 |
| 4,177,952 | A | | 12/1979 | Rikker | 209/144 X |
| 4,213,852 | A | | 7/1980 | Etkin | 209/136 |
| 4,354,641 | A | | 10/1982 | Smith | 241/40 |
| 4,361,404 | A | | 11/1982 | Colin et al. | 241/110 X |
| 4,418,871 | A | * | 12/1983 | Powell | 209/135 X |
| 4,449,566 | A | | 5/1984 | Filpovitch et al. | 164/5 |
| 4,491,277 | A | | 1/1985 | Bauer et al. | 241/5 |
| 4,514,168 | A | | 4/1985 | McMath et al. | 432/14 |
| 4,566,637 | A | | 1/1986 | Deve | 241/23 |
| 4,574,045 | A | | 3/1986 | Crossmore, Jr. | 209/142 X |

(List continued on next page.)

FOREIGN PATENT DOCUMENTS

| | | | | |
|---|---|---|---|---|
| DE | 12 93 003 B | | 4/1969 | |
| DE | 43 39 532 A | | 8/1994 | |
| DE | 4339532 | * | 8/1994 | 209/135 |
| GB | 2 110 959 A | | 6/1983 | |
| WO | 88 00861 A | | 2/1988 | |

OTHER PUBLICATIONS

GE Classifiers, "Gravitational Classifier", Oct. 1992, p. 1.1.

Modern Casting, "Silica Threatens Your Existence", Alfred T. Spada, Feb. 2000.

*Primary Examiner*—Tuan N. Nguyen
(74) *Attorney, Agent, or Firm*—Jacobson Holman PLLC

(57) ABSTRACT

An air classifier with enhanced air flow which maybe used for the simultaneous recovery of two or more distinct grades of foundry quality sand from a single sand stream. The air classifier exhibits improved performance by drawing into the classification chamber, through the use of suction, incoming air through a honeycomb followed by a screen section having two or more screens. The honeycomb removes swirl in the air and the screens slow down the fast moving air more than the slow moving air. After passing through the screens, the velocity profile of the air in the chamber is flat across the inlet flow path and, as a result, improved classification performance is achieved. Classification performance may be further enhanced through the use of a vibrating screen feeder for spreading the incoming particle stream before entrainment in the air flow within the classifier and through upward flowing air in one or more product receiver sections.

20 Claims, 6 Drawing Sheets

U.S. PATENT DOCUMENTS

| | | | | | |
|---|---|---|---|---|---|
| 4,604,140 | A | | 8/1986 | Lalancette et al. | 106/38.9 |
| 4,636,168 | A | | 1/1987 | Sandstrom et al. | 134/2 X |
| 4,671,867 | A | | 6/1987 | Battie et al. | 209/3 |
| 4,702,304 | A | | 10/1987 | Rice | 164/529 |
| 4,735,973 | A | | 4/1988 | Brander | 523/139 |
| 4,738,615 | A | | 4/1988 | Bailey et al. | 432/15 |
| 4,759,840 | A | * | 7/1988 | McIntyre et al. | 209/33 X |
| 4,978,076 | A | | 12/1990 | Andrews et al. | 241/5 |
| 4,980,394 | A | | 12/1990 | Lemon et al. | 523/145 |
| 5,019,302 | A | | 5/1991 | Sparks et al. | 264/8 |
| 5,032,256 | A | | 7/1991 | Vickery | 209/135 |
| 5,045,090 | A | | 9/1991 | Pohl | 241/DIG. 10 X |
| 5,094,289 | A | | 3/1992 | Gentry | 164/529 |
| 5,100,592 | A | | 3/1992 | Sparks et al. | 264/7 |
| 5,163,562 | A | | 11/1992 | Wilhelm et al. | 209/144 X |
| 5,219,123 | A | | 6/1993 | Jacob | 241/5 |
| 5,271,450 | A | | 12/1993 | Bailey | 164/5 |
| 5,279,741 | A | | 1/1994 | Schott | 241/17 X |
| 5,289,920 | A | | 3/1994 | Godderidge et al. | 209/2 |
| 5,299,618 | A | | 4/1994 | Fumagalli | 241/5 X |
| 5,423,370 | A | | 6/1995 | Bonnemasou et al. | 164/132 |
| 5,520,341 | A | | 5/1996 | Boenisch | 241/41 |
| 5,706,879 | A | | 1/1998 | Renner et al. | 241/19 X |
| 5,794,865 | A | | 8/1998 | Didion et al. | 241/74 |
| 5,865,236 | A | | 2/1999 | Hansen et al. | 164/5 |

* cited by examiner 10
12
FEED
Screen
16
14
AIR
Honeycomb
20
RECEIVERS
AIR EXIT
WITH VERY
FINE PARTICLES
(Fraction J)
FRACTIONS (All dimensions are in mm)

D60/D10 vs. Distance At Three Feed Rates With Screen Section in Place

AIR INLET TO PARTICLE RECEIVER
(SCREENS USED TO GIVE
UNIFORM UPWARD VELOCITY)

AIR CLASSIFIER SYSTEM FOR THE SEPARATION OF PARTICLES

BACKGROUND OF THE INVENTION

1. Field of the Invention

The present invention is related to the field of particle classification and, in an important embodiment, to an air classifier system for simultaneously separating a single sand stream into two or more distinct grades of foundry quality sand.

2. Description of the Related Art

Particle separation and classification is a necessary part of many industrial processes. Air classification is effective in many instances and, through the introduction of a stream of particulate matter to an air stream, relies upon terminal velocity of the particles to separate particles of different sizes, shapes and composition. Particles remain in the air stream over a distance which is inversely proportional to their terminal velocities. Through the use of receiver sections located beneath the air flow, particles having similar velocities may be collected in respective sections.

Central to an air classification system is the flow of air through the classifier. Prior art methods of air classification typically rely on a blower or fan feeding air into the classification section, or the air going into this section comes from the recycle of air from such a fan or blower. Using such techniques, the air is extremely disturbed, with high levels of turbulence and severe swirling on a large scale. This turbulence and swirling reduces the accuracy of the classification achieved.

To deal with these severe swirl problems, prior art solutions have relied upon a screen section, including one or multiple screens, followed by a honeycomb arrangement to direct and smooth the air flow. U.S. Pat. No. 5,032,256 to Vickery is representative of such an air classifier system. U.S. Pat. No. 4,213,852 to Etkin also illustrates such a system, using multiple screens. With the prior art systems, swirl is reduced but remains a problem. In addition, while specifying the use of a honeycomb to remove large scale swirl from the incoming air, the patent to Vickery teaches that the cell length to cell diameter ratio (L/D) of the individual honeycomb cells should be 20/1, but in all cases must be higher than 8/1.

Prior art air classifier systems also suffer from ineffective control of the particle feed stream. Using prior art techniques, the feed stream of particles entering an air classifier often falls as a thin stream transverse to the flowing air. This has an adverse effect on the operation of the classifier, except at very low feed rates, e.g., less than 10 gm/min/cm of the transverse feed stream (or approximately 1 kg/min for a classifier one meter in width). At higher, and more practical, feed rates, the particle concentration is so high that the particles do not fall individually as they enter the classifier, but as a solid "curtain". This has two deleterious effects. First, the incoming feed curtain blocks the air flow at the top of the classifier, diverting the air downward, negating the effort of creating an even, undisturbed air stream. The result is the particles are not separated nearly as well as would be anticipated were they to be acted upon individually by the air. Second, the particles falling in the feed curtain are not separated during the initial part of their fall into the air stream. The fine particles fall along with the larger particles, instead of being blown free of them. This results in a defective separation, with smaller particles falling into earlier receiving chambers meant for the large particles. These effects become more pronounced as the feed rate increases.

Accordingly, a need exists for an air classifier system having adequate control of both swirl and the incoming particle feed stream in order to obtain particle separations of discrete ranges having greater internal uniformity.

SUMMARY OF THE INVENTION

In view of the foregoing, one object of the present invention is to reduce swirl in the air flow to an air classifier system through the use of quiescent ambient air which is pulled from outside the classifier rather than pushed into the classifier.

Another object of the invention is to provide an air classifier that permits use of a honeycomb with a cell length to cell diameter ratio (L/D) as low as 4.

A further object of the invention is to provide an air classifier in which the honeycomb is placed before the screen section in order to achieve maximum reduction in swirling of the air.

A still further object of the invention is to provide an air classifier having a screen section which includes only two or three screens and yet reduces mean variations in velocity measured at evenly spaced positions across the airstream to less than 5% of the mean velocity.

An additional object of the invention is an air classifier in which the incoming feed stream is spread by widening the aperture through which feed enters the classifier and directing the feed stream through one or more vibrating screens.

Yet another object of the invention is to provide an air classifier with enhanced particle separation capability even at high feed rates through the introduction of an upward air flow within the receiving chambers.

In accordance with these and other objects, the present invention is directed to an air classifier for separating particulate material. The air classifier includes a horizontally disposed classification chamber having an upstream end and a downstream end. The upstream and downstream ends allow air to flow into and out of the chamber, respectively. An air suction device is located adjacent the downstream end of the chamber for drawing air through the chamber from the upstream end to create a chamber air stream. Particulate matter is fed into the chamber through a feed stream input located in an upper part of the chamber proximate the upstream end. Particles entering the chamber are entrained in the chamber air stream.

The air classifier further includes a screen section situated adjacent to and upstream of the upstream end of the chamber, and a honeycomb located adjacent to and upstream of the screen section. Air entering the chamber first passes through the honeycomb, and then through the screen section. The honeycomb takes out the swirl in the air and the screen section slows down the faster moving portions of the air more than the slower moving portions. As a result, the velocity profile of the smoothed air is much more constant across the entire flow path. Particles introduced to the chamber through the feed stream input are entrained in the smoothed air as it exits the screen section.

A plurality of receiver sections are serially disposed in an upstream to downstream arrangement along the bottom of the chamber. As particles entrained in the chamber air stream fall out, these particles are collected in the receiver sections. Larger and/or heavier particles fall out sooner and are collected in receiver sections nearest the feed stream input, while smaller/lighter particles remain entrained for a longer period and are collected in receiver sections closer to the downstream end of the chamber.

In a preferred embodiment, the feed stream input includes a vibrating screen feeder which aids in separating the fine particles from the large particles at the input, permitting the air to act upon the particles more individually, and reducing the amount of fines otherwise introduced into the receiver sections intended to collect the larger particles. An upward flow of air may also be introduced within the receiver sections, moderated by screens placed above the air inlets, to keep more of the fines entrained and moving toward appropriate receiver sections.

Through the honeycomb and screen section arrangement at the upstream end of the chamber, combined with the drawing of air through the classifier by suction, air turbulence is reduced and, particularly when combined with greater separation of the incoming feed stream through vibration, the present invention makes more accurate classification of particulate matter possible.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
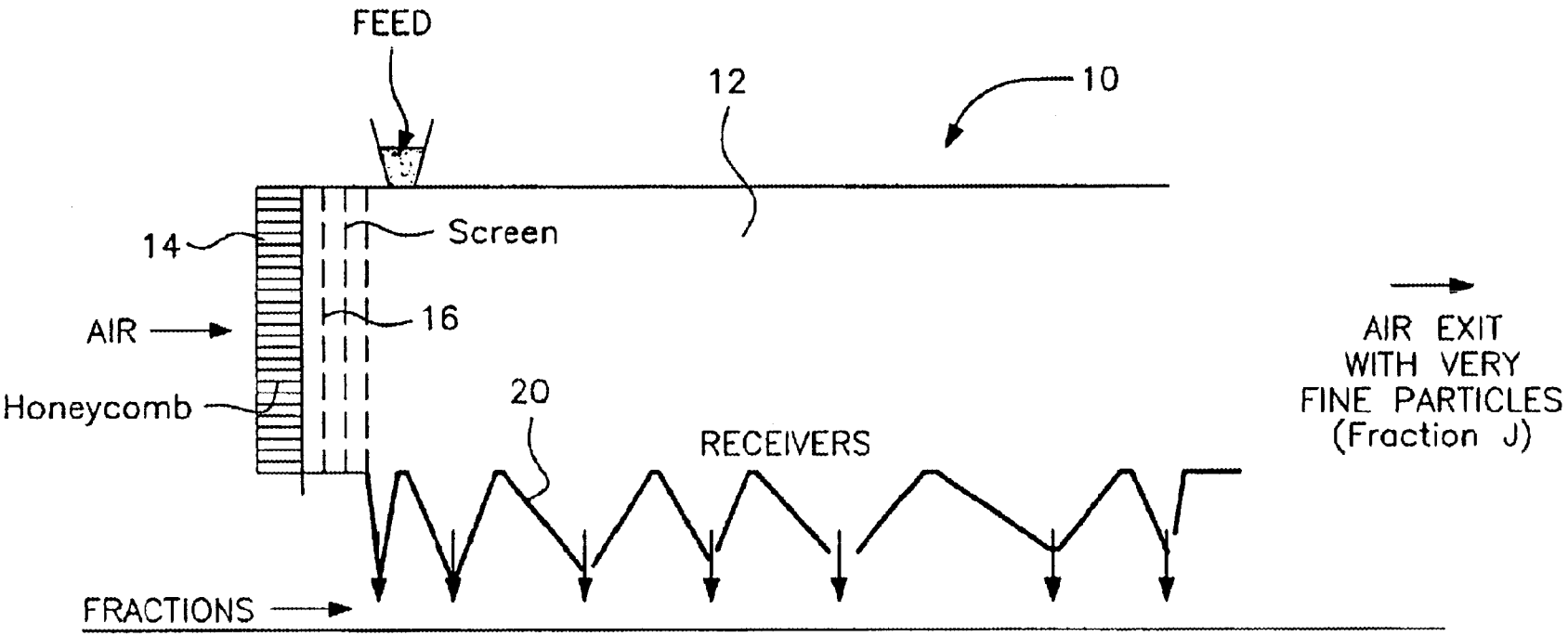
FIG. 1 shows an air classifier in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
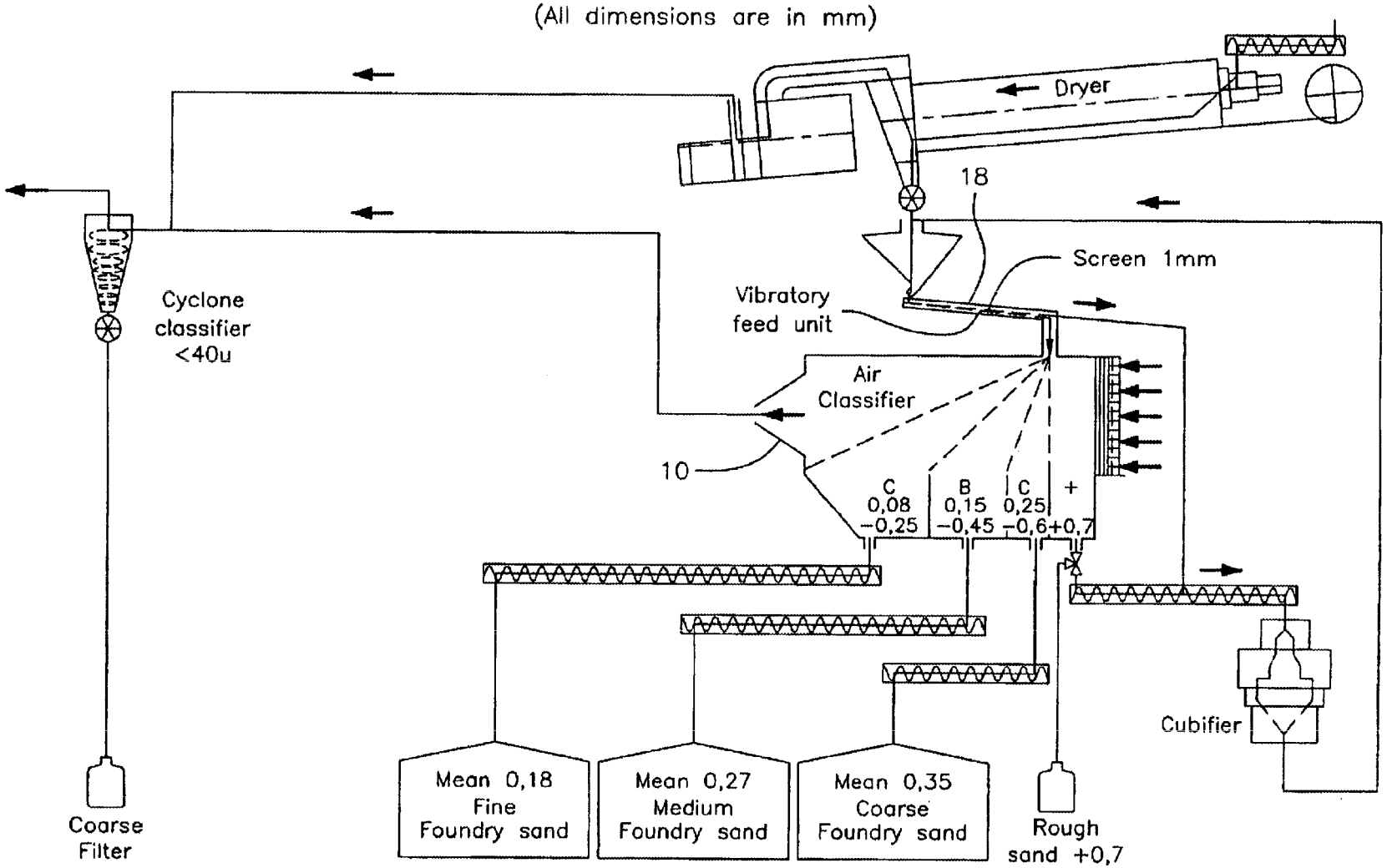
FIG. 2 illustrates the air classifier of the present invention as configured for operation.

A representative air classifier system in accordance with the present invention, generally designated by the reference numeral 10, is shown in FIG. 1. The air classifier 10 as configured for operation is shown in FIG. 2.

Air is drawn into the classifier chamber 12 through a honeycomb 14, which is followed by at least one screen 16. Particles fall from the air stream into one of a plurality of receiver sections 20. To draw the air, a blower (not shown) is placed at the exit end of the classifier, after the bag filters (not shown). The suction end of the blower is attached to the exit end of the classifier, pulling air through the classifier. This permits all the air to be pulled in from the room or atmosphere outside the classifier, where the air is quite calm compared to the air in the prior art arrangements in which the air is recycled or forced into the classifier by a fan or blower. As a result, the process of removing turbulence and swirl from the incoming air stream to obtain a uniform velocity of the classifier air containing virtually no swirl or turbulence is greatly simplified. A honeycomb is used to reduce the swirl and, due to the low swirl in the incoming air as a result of the present invention, it is possible to use honeycombs 14 with a L/D of only 4 to accomplish the removal of the small amount of swirl. This is a considerable improvement over the L/D of 20/1, with a minimum of 8/1, as taught in the prior art.

The cell size of the honeycomb should be less than one-tenth of the height of the longitudinal air stream. Function is improved if the cell size is smaller, and can often be 1/30–1/200 of the air stream height.

In contrast to prior art classifiers, the honeycomb 14 in the present invention is placed before the screen section 16, not after it as in Vicker. This placement is desirable because the solid separators between the open cells of the honeycomb generate turbulent wakes in the air passing over them. The scale of this turbulence is larger than the turbulence being formed and damped by the screens; hence, it should be removed to give the smoothest air flow. Removal of such turbulence is accomplished by placing the honeycomb 14 before the screens 16. It is possible, however, to place the honeycomb after the screen section, if desired, with little loss in the efficiency of the classification.

As shown in FIG. 1, the present invention may include multiple screens 16 to smooth out the incoming air stream. In a preferred embodiment, two screens, and a maximum of three screens, are sufficient to give mean variations in velocity less than ±5% of the mean velocity when the screens are properly chosen.

To produce these results at mean air velocities of 0.5–5 meters/second, which velocities are typical of the velocities used with the present invention, the screens should have a fraction open area of 55–60%. Lower fractions of open area will also accomplish the task of smoothing the velocity profile, but at a cost of higher energy expenditure. Higher fractions of open area require the use of more screens, increasing the cost of the apparatus. The optimal choice of fraction open area of the screen is that fraction for which the minimum number of screens are required, minimizing the energy required to smooth the velocity profile and decreasing the turbulence in the air stream.

It is best to place the screens from thirty to one hundred wire diameters apart to permit the decay of the turbulence from the wires in each screen. This avoids having a screen smooth the wakes coming from the wires of the previous screen. Beyond one hundred wire diameters, these individual wakes will have disappeared for all practical purposes and the turbulent velocity fluctuations will be small scale and reduced to only 1% of the average velocity. Placing the screens farther apart increases the length of the classifier. Similar reasoning indicates that the first screen should be placed downstream of the honeycomb by 30–100 times the mean thickness of the solid separators between the individual honeycomb cells.

As a last consideration, the screens 16 should consist of wire which is sufficiently sturdy to minimize both initial cost and the maintenance/cleaning/replacement costs of the screens. Extremely fine screens, e.g., 100 mesh, can be placed close together, but they are expensive and can be blocked easily by incoming dust. Very coarse screens, e.g., 2 mesh, must be placed very far apart, increasing the length of the classifier. Practically, these limitations mean that the screens should be 2–20 mesh. As an example, an 8 mesh screen will have an opening of roughly 80 mils (2,000 microns) or about 1/12 inch. This gives a screen wire of roughly 20 mils (500 microns), which is relatively sturdy and requires the screens to be about two inches apart.

Various tests were run to evaluate the impact of the honeycomb and screen arrangement on air classifier performance. In each run, the velocity was measured (and averaged) across the classifier just upstream of the feed position for the sand. This measurement was taken with and without the honeycomb-screen section in place. Run 1 with the honeycomb screen section in place, summarized in Table I, had an average air flow of 1.68 mps. Run 2 without the honeycomb-screen section, summarized in Table II, had an average air flow of 1.62 mps. This was close enough that no further adjustments were made. The sand to be classified was placed into the hopper and allowed to flow onto the moving conveyor belt. The vibrating feeder was set to 100%. The sand was observed during the runs through the viewing windows in the side of the apparatus. With the honeycomb-screen section in place, the sand flow was steady and horizontal. Without the honeycomb-screen section in place the sand was observed to eddy and swirl from side to side. The fractions of sand were collected after each run was completed. Samples were taken and a sieve analysis was done to determine the separation achieved. A comparison of the data in Tables I and II shows that operation of the classifier with the honeycomb-screen section in place yields a much sharper classification of the particles.

As the larger particles fall into receiver section A at the bottom of the classifier, they carry along finer particles which have fallen with them in the upper part of the feed stream before the air begins to act on the individual particles. This phenomenon becomes more pronounced as the feed rate increases. These fines are undesirable in the product represented by the larger particles. The amount of fines in any receiver section can be reduced, sharpening the separation, by feeding air into the bottom or sides of the receiver section. This upward-rising air carries the finer particles out the top of the receiver into the main classifier air stream where they will be carried toward subsequent receiver sections where the finer particles belong. This technique can be used to decrease the fraction of fine particles falling into any receiver section. The volumetric air flow into any receiver section should be less than 1/3 the volumetric air flow in the main classifier to avoid undue disruption of the main classification action.

TABLE I

SIZE DISTRIBUTION OF RECEIVER FRACTIONS (%) (IMPROVED AIR-FLOW CONTROL)

| Screen Fraction Size (Microns) | Position Downstream from Feed Point: B | C | D | E-1 | E-2 | E-3 | E-4 | F-1 | F-2 | G | H | I | Feed % by Sum of Fractions | Feed % by Direct Sieving | Difference |
|---|---|---|---|---|---|---|---|---|---|---|---|---|---|---|---|
| 0–38 | 0 | 0 | 0.0 | 0.0 | 0.0 | 0.0 | 0.0 | 0.0 | 0.0 | 0.0 | 0.0 | 0 | 0.0 | 0 | 0.00 |
| 38–75 | 0 | 0 | 0.0 | 0.0 | 0.0 | 0.0 | 0.0 | 0.0 | 0.0 | 0.0 | 0.0 | 2 | 0.1 | 0 | −0.11 |
| 75–90 | 0 | 0 | 0.0 | 0.0 | 0.0 | 0.0 | 0.0 | 0.0 | 0.0 | 0.0 | 0.0 | 5 | 0.3 | 0 | −0.27 |
| 90–125 | 0 | 0 | 0.0 | 0.0 | 0.0 | 0.0 | 0.0 | 0.0 | 0.0 | 1.0 | 24.0 | 58 | 4.5 | 1 | −3.52 |
| 125–150 | 0 | 0 | 0.0 | 0.0 | 0.0 | 0.0 | 0.0 | 0.0 | 1.0 | 28.0 | 54.0 | 27 | 7.1 | 3 | −4.10 |
| 150–180 | 0 | 0 | 0.0 | 0.0 | 0.0 | 0.0 | 2.0 | 20.0 | 58.0 | 58.0 | 20.0 | 8 | 12.5 | 12 | −0.46 |
| 180–212 | 0 | 0 | 0.0 | 0.0 | 1.0 | 10.0 | 28.0 | 37.0 | 26.0 | 9.0 | 2.0 | 0 | 7.2 | 9 | 1.79 |
| 212–250 | 0 | 0 | 0.0 | 23.0 | 53.0 | 69.0 | 63.0 | 40.0 | 14.0 | 3.0 | 0.0 | 0 | 16.1 | 15 | −1.05 |
| 250–300 | 1 | 0 | 18. | 60 | 35.0 | 18.0 | 4.0 | 3.0 | 1.0 | 1.0 | 0.0 | 0 | 11.6 | 12 | 0.44 |
| 300–420 | 5 | 78 | 78.0 | 17.0 | 11.0 | 3.0 | 3.0 | 0.0 | 0.0 | 0.0 | 0.0 | 0 | 32.8 | 26 | −6.73 |
| 420–500 | 11 | 8 | 3.0 | 0.0 | 0.0 | 0.0 | 0.0 | 0.0 | 0.0 | 0.0 | 0.0 | 0.0 | 2.5 | 9 | 6.44 |
| 500–600 | 31 | 7 | 0.0 | 0.0 | 0.0 | 0.0 | 0.0 | 0.0 | 0.0 | 0.0 | 0.0 | 0.0 | 2.3 | 5 | 3.56 |
| 600–710 | 41 | 6 | 1.0 | 0.0 | 0.0 | 0.0 | 0.0 | 0.0 | 0.0 | 0.0 | 0.0 | 0.0 | 2.5 | 3 | 0.45 |
| >710 | 11 | 1 | 0.0 | 0.0 | 0.0 | 0.0 | 0.0 | 0.0 | 0.0 | 0.0 | 0.0 | 0.0 | 0.5 | 0 | −0.50 |
| Total % | 100 | 100 | 100 | 100 | 100 | 100 | 100 | 100 | 100 | 100 | 100 | 100 | 100 | 95 | |
| % of | 2.5 | 22.4 | 16.4 | 7.7 | 6.7 | 5.8 | 4.1 | 7.2 | 7.0 | 9.2 | 5.5 | 5.3 | Total | 99.8 | |
| Collected products | | | | | | | | | | | | | | | |
| Weight | 57 | 515 | 377.2 | 177.5 | 155.7 | 132.2 | 96 | 164.6 | 159.4 | 212.8 | 127.4 | 123.1 | | 2297.9 | |

| Mean Size (Microns) | Cumulative weight % smaller than: B | C | D | E-1 | E-2 | E-3 | E-4 | F-1 | F-2 | G | H | I (2500 gm fed) |
|---|---|---|---|---|---|---|---|---|---|---|---|---|
| 19 | 0 | 0 | 0 | 0 | 0 | 0 | 0 | 0 | 0 | 0 | 0 | 0 |
| 56.5 | 0 | 0 | 0 | 0 | 0 | 0 | 0 | 0 | 0 | 0 | 0 | 2 |
| 62.5 | 0 | 0 | 0 | 0 | 0 | 0 | 0 | 0 | 0 | 0 | 0 | 7 |
| 107.5 | 0 | 0 | 0 | 0 | 0 | 0 | 0 | 0 | 0 | 1 | 24 | 65 |
| 137.5 | 0 | 0 | 0 | 0 | 0 | 0 | 0 | 0 | 1 | 29 | 78 | 92 |
| 165 | 0 | 0 | 0 | 0 | 0 | 0 | 2 | 20 | 59 | 87 | 98 | 100 |
| 196 | 0 | 0 | 0 | 0 | 1 | 10 | 30 | 57 | 65 | 96 | 100 | 100 |
| 231 | 0 | 0 | 0 | 23 | 54 | 79 | 93 | 97 | 99 | 99 | 100 | 100 |
| 275 | 1 | 0 | 18 | 83 | 89 | 97 | 97 | 100 | 100 | 100 | 100 | 100 |
| 360 | 6 | 78 | 95 | 100 | 100 | 100 | 100 | 100 | 100 | 100 | 100 | 100 |
| 460 | 17 | 86 | 99 | 100 | 100 | 100 | 100 | 100 | 100 | 100 | 100 | 100 |
| 550 | 48 | 93 | 99 | 100 | 100 | 100 | 100 | 100 | 100 | 100 | 100 | 100 |
| 655 | 89 | 99 | 100 | 100 | 100 | 100 | 100 | 100 | 100 | 100 | 100 | 100 |

TABLE II

SIZE DISTRIBUTION OF RECEIVER FRACTIONS (%) (NORMAL OPERATION)

| Screen Fraction Size (Microns) | Position Downstream from Feed Point: B | C | D | E-1 | E-2 | E-3 | E-4 | F-1 | F-2 | G | H | I | Feed: % by Sum of Fraction | Direct Sieving | Difference |
|---|---|---|---|---|---|---|---|---|---|---|---|---|---|---|---|
| 0–38 | 0 | 0 | 0.0 | 0.0 | 0.0 | 0.0 | 0.0 | 0.0 | 0.0 | 0.0 | 0.0 | 0 | 0.0 | 0 | 0.00 |
| 38–75 | 0 | 0 | 0.0 | 0.0 | 0.0 | 0.0 | 0.0 | 0.0 | 0.0 | 0.0 | 0.0 | 1 | 0.1 | 0 | −0.05 |
| 75–90 | 0 | 0 | 0.0 | 0.0 | 0.0 | 0.0 | 0.0 | 0.0 | 0.0 | 0.0 | 1.0 | 8 | 0.5 | 0 | −0.48 |
| 90–125 | 0 | 0 | 0.0 | 0.0 | 0.0 | 0.0 | 0.0 | 0.0 | 1.0 | 2.0 | 3.0 | 22 | 1.5 | 1 | −0.59 |
| 125–150 | 0 | 0 | 0.0 | 0.0 | 0.0 | 0.0 | 0.0 | 0.0 | 3.0 | 5.0 | 9.0 | 45 | 3.6 | 3 | −0.57 |
| 150–180 | 0 | 0 | 0.0 | 1.0 | 0.0 | 0.0 | 1.0 | 2.0 | 8.0 | 14.0 | 35.0 | 15 | 4.9 | 12 | 7.09 |
| 180–212 | 0 | 0 | 1.0 | 2.0 | 1.0 | 2.0 | 3.0 | 3.0 | 8.0 | 14.0 | 23.0 | 8 | 4.4 | 9 | 4.60 |
| 212–250 | 0 | 2 | 2.0 | 6.0 | 4.0 | 9.0 | 9.0 | 15.0 | 31.0 | 43.0 | 25.0 | 1 | 11.1 | 15 | 3.94 |
| 250–300 | 1 | 6 | 3.0 | 11 | 5.0 | 13.0 | 16.0 | 31.0 | 34.0 | 19.0 | 2.0 | 0 | 10.9 | 12 | 1.08 |
| 300–420 | 27 | 39 | 20.0 | 51.0 | 78.0 | 73.0 | 68.0 | 48.0 | 14.0 | 3.0 | 1.0 | 0 | 33.7 | 25 | −7.68 |
| 420–500 | 29 | 21 | 34.0 | 20.0 | 5.0 | 1.0 | 2.0 | 1.0 | 1.0 | 0.0 | 0.0 | 0 | 13.2 | 9 | −4.18 |
| 500–600 | 21 | 15 | 22.0 | 8.0 | 6.0 | 1.0 | 1.0 | 0.0 | 0.0 | 0.0 | 0.0 | 0 | 8.6 | 6 | −2.62 |
| 600–710 | 14 | 12 | 13.0 | 1.0 | 1.0 | 1.0 | 0.0 | 0.0 | 0.0 | 0.0 | 0.0 | 0 | 5.4 | 3 | −2.38 |
| >710 | 8 | 5 | 5.0 | 0.0 | 0.0 | 0.0 | 0.0 | 0.0 | 0.0 | 0.0 | 0.0 | 0 | 2.1 | 0 | −2.14 |
| Total % | 100 | 100 | 100 | 100 | 100 | 100 | 100 | 100 | 100 | 100 | 99 | 100 | 100 | 95 | |
| % of | 1.7 | 6.3 | 12.8 | 8.3 | 6.0 | 6.9 | 6.0 | 10.5 | 8.8 | 13.7 | 9.5 | 9.5 | Total | 100 | |
| Collected product: | | | | | | | | | | | | | | | |
| Weight | 32.7 | 122.7 | 249.2 | 162.8 | 119.3 | 135 | 118.1 | 207 | 173.1 | 259.5 | 188.7 | 185.9 | | 1954 | |

| Mean Size (Microns) | Cumulative weight % smaller than: B | C | D | E-1 | E-2 | E-3 | E-4 | F-1 | F-2 | G | H | I | (2500 gms. fed) |
|---|---|---|---|---|---|---|---|---|---|---|---|---|---|
| 19 | 0 | 0 | 0 | 0 | 0 | 0 | 0 | 0 | 0 | 0 | 0 | 0 | |
| 56.5 | 0 | 0 | 0 | 0 | 0 | 0 | 0 | 0 | 0 | 0 | 0 | 1 | |
| 62.5 | 0 | 0 | 0 | 0 | 0 | 0 | 0 | 0 | 0 | 0 | 1 | 9 | |
| 107.5 | 0 | 0 | 0 | 0 | 0 | 0 | 0 | 0 | 1 | 2 | 4 | 31 | |
| 137.5 | 0 | 0 | 0 | 0 | 0 | 0 | 0 | 0 | 4 | 7 | 13 | 76 | |
| 165 | 0 | 0 | 0 | 1 | 0 | 0 | 1 | 2 | 12 | 21 | 49 | 91 | |
| 196 | 0 | 0 | 1 | 3 | 1 | 2 | 4 | 5 | 20 | 35 | 72 | 99 | |
| 231 | 0 | 2 | 3 | 9 | 5 | 11 | 13 | 20 | 51 | 78 | 97 | 100 | |
| 275 | 1 | 8 | 6 | 20 | 10 | 24 | 29 | 51 | 85 | 97 | 99 | 100 | |
| 360 | 28 | 47 | 26 | 71 | 66 | 97 | 97 | 99 | 99 | 100 | 100 | 100 | |
| 460 | 57 | 68 | 60 | 91 | 93 | 98 | 99 | 100 | 100 | 100 | 100 | 100 | |
| 550 | 76 | 83 | 82 | 99 | 99 | 99 | 100 | 100 | 100 | 100 | 100 | 100 | |
| 655 | 92 | 95 | 95 | 100 | 100 | 100 | 100 | 100 | 100 | 100 | 100 | 100 | |

The air classifier of the present invention also includes a means by which the incoming feed particles can be presented to the air stream more individually. Surprisingly, this can be done at quite high feed rates if the feed stream can enter the air stream as a more dilute curtain, with the particles spread apart evenly in the direction of air flow, recovering some of the advantage of having a uniform air stream entering the classifier. The spreading of the feed stream is best done by widening the aperture through which the feed enters the classifier and having the feed stream fall, just prior to entering the air stream, through one or two screens 18 which are vibrating, either in the direction of air flow or transverse to it. The vibrations of the screen 18 aid in separating the fine particles from the large particles, freeing them to be carried individually into the classifier air stream. It is best if the amplitude of this vibration is low, since high amplitudes can throw the particles too far and, if the frequency is high, help to avoid blockage of the screen. The amplitude should be less than 5 mm and the frequency should be above 3 cycles per second. It is best if the screen openings are at least three times larger than the diameter of the largest particles which are to pass freely through them.

When the feed stream is spread in this fashion, there is a decrease in the sharpness of separation which could be obtained in ideal operation of the classifier, since the feed is no longer entering at a single position. However, the reason the feed is being spread is because the actual operation is already far from ideal when the feed rate is high. The improvement in classification which is realized from the additional spreading obtained through an increase in the width of the feed stream more than offsets the few inches of broadening of the feed stream. However, the breadth of the feed stream in the air stream direction should not exceed ¼ of the receiver opening in the feed stream direction for an important product receiver, and ⅛ would decrease the effect even further.

Test results obtained without a vibrating screen feeder and with a vibrating screen feeder are summarized in Tables III and IV, respectively. These data indicate that the feed stream behaves less like a solid curtain when the stream is spread slightly in the direction of air flow. The large solids fall more freely into an earlier section and there is a cleaner separation of the particles, with fewer fine particles in each receiver.

TABLE III

SIZE DISTRIBUTION OF RECEIVER FRACTIONS (%)
(NORMAL FEED)
Position Downstream from Feed Point

| Screen Fraction (microns) | A | B | C | D | E | F | G | H | I | J | FEED |
|---|---|---|---|---|---|---|---|---|---|---|---|
| >850 | | | | 1 | T | 0 | 0 | 0 | 0 | 0 | T |
| 500–850 | | | | 49 | 65 | 0 | 0 | 0 | 0 | 0 | 2 |
| 250–500 | | | | 50 | 87 | 8 | T | T | T | 0 | 44 |
| 150–250 | | | | T | 8 | 88 | 92 | 75 | 38 | T | 43 |
| 90–150 | | | | 0 | T | 4 | 8 | 25 | 42 | 1 | 4 |
| 53–90 | | | | 0 | T | T | T | T | 1 | 1 | T |
| <53 | | | | 0 | T | T | T | T | 19 | 98 | 7 |

T = Trace amount

TABLE IV

SIZE DISTRIBUTION OF RECEIVER FRACTIONS (%)
(IMPROVED FEED SYSTEM)
Position Downstream from Feed Point

| Screen Fraction (microns) | A | B | C | D | E | F | G | H | I | J | FEED |
|---|---|---|---|---|---|---|---|---|---|---|---|
| >850 | | | 1 | T | 0 | 0 | 0 | 0 | 0 | 0 | T |
| 500–850 | | | 45 | 11 | 1 | 0 | 0 | 0 | 0 | 0 | 2 |
| 250–500 | | | 54 | 89 | 85 | 13 | 1 | T | T | 0 | 44 |
| 150–250 | | | 0 | 0 | 14 | 85 | 92 | 76 | 44 | T | 43 |
| 90–150 | | | 0 | 0 | T | 2 | 7 | 24 | 49 | 2 | 4 |
| 53–90 | | | 0 | 0 | 0 | 0 | 0 | 0 | T | T | T |
| <53 | | | 0 | 0 | 0 | 0 | 0 | T | | 98 | 7 |

T = Trace amount

Figure 3:
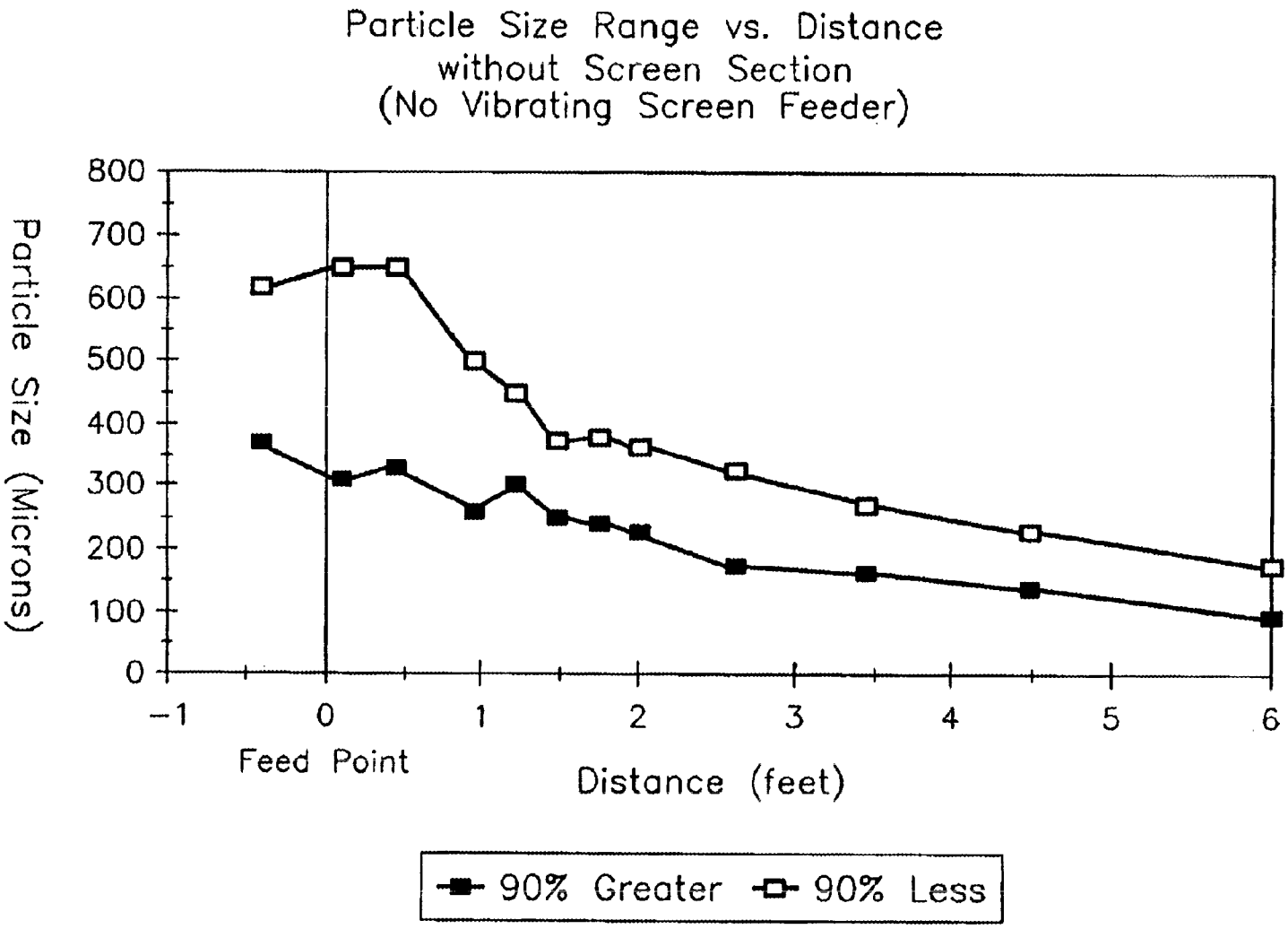
FIG. 3 is a graph depicting particle size range vs. distance for tests conducted using an air classifier without a screen section and without a vibrating screen feeder.
Figure 4:
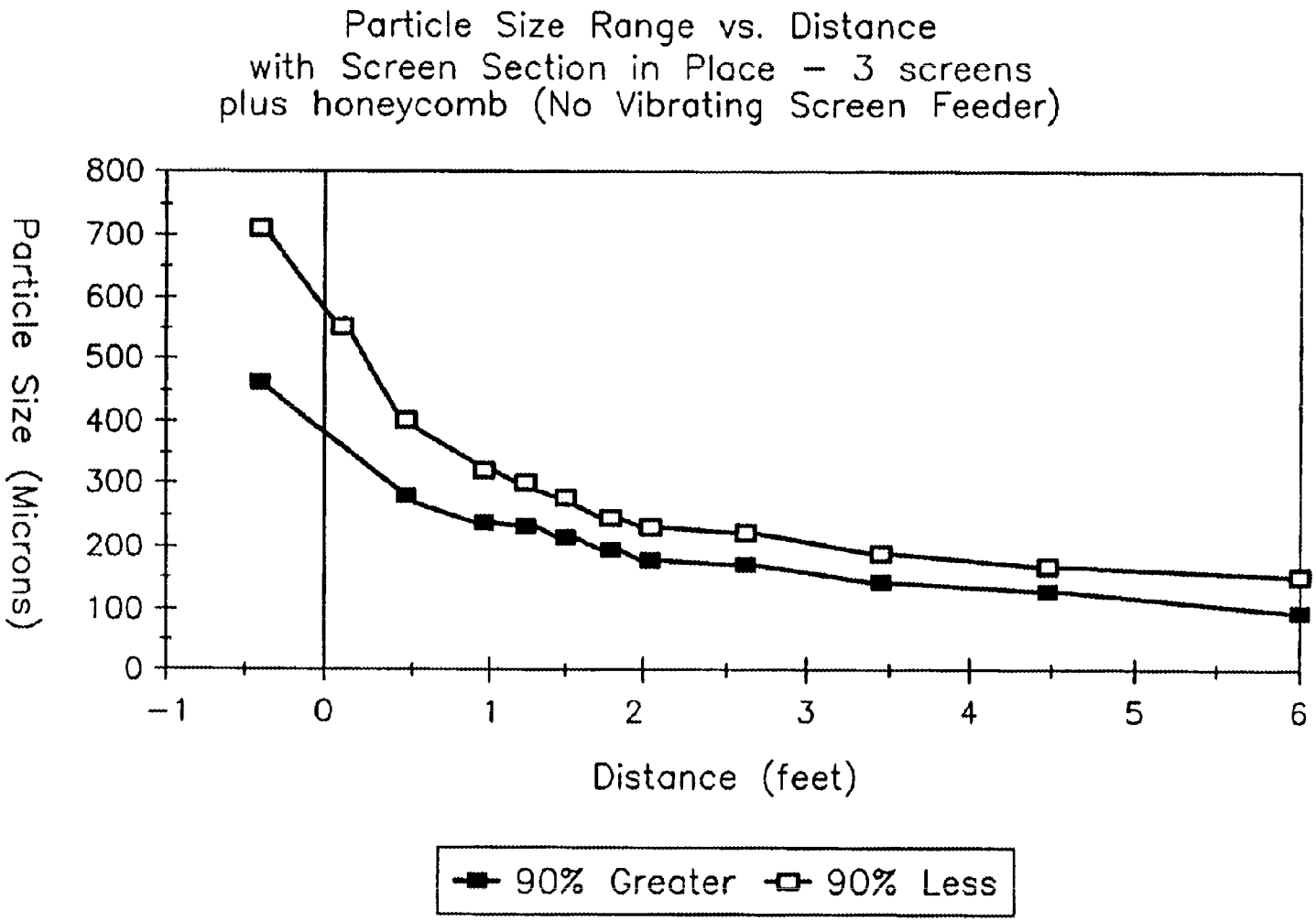
FIG. 4 is a graph depicting particle size range vs. distance using an air classifier with a screen section in place and without a vibrating screen feeder.

FIG. 3 is a graph of particle size range versus distance traveled from the feed point when using an air classifier without a honeycomb-screen section and without the use of the vibrating screen feeder 18. FIG. 4 is a graph of the same parameters, also without a vibrating screen feeder, but with a honeycomb-screen section 16 having three screens in place following the honeycomb. As shown, the inclusion of the honeycomb-screen section significantly reduces the width of the size distribution of the particles at all points.

Figure 5:
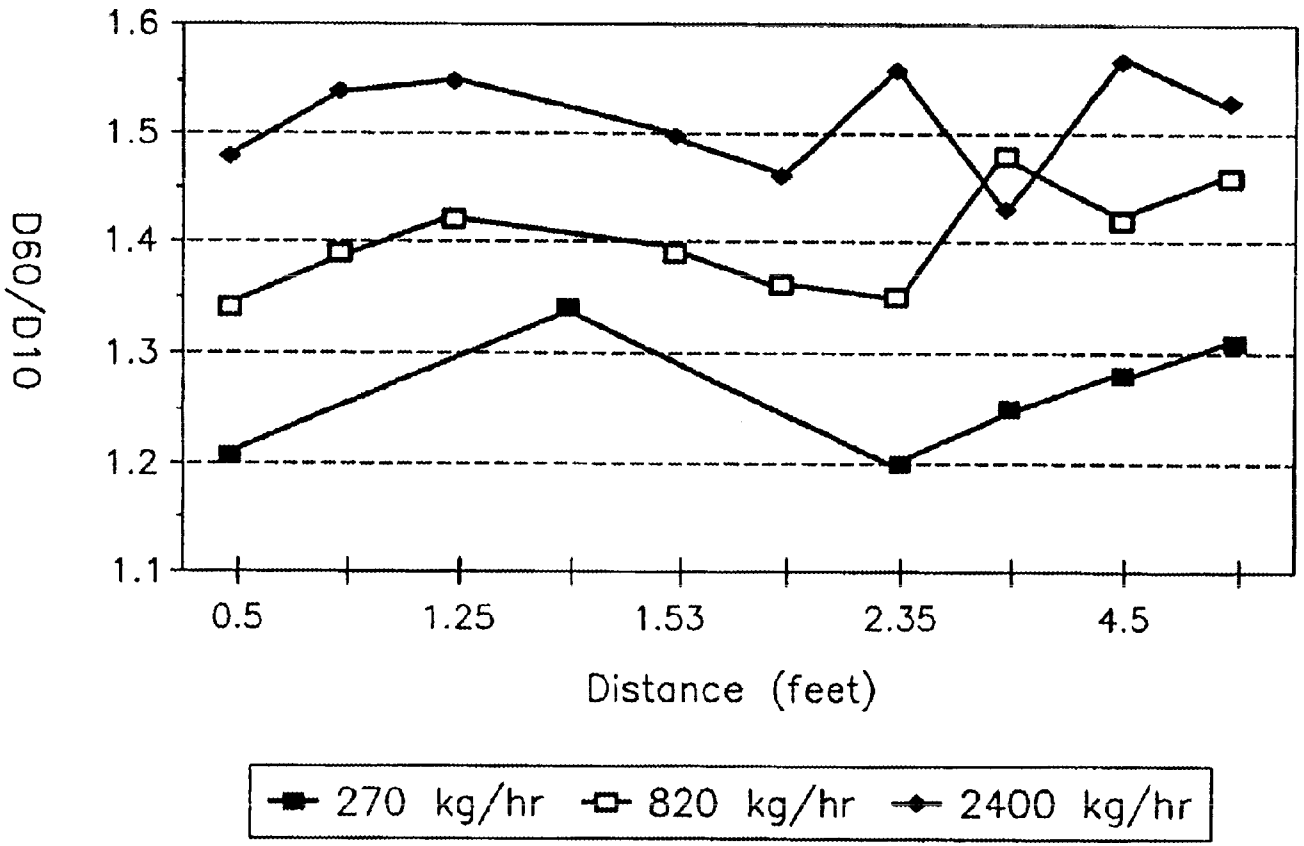
FIG. 5 is a comparative graph of air classifier performance at three feed rates with a screen section in place.

FIG. 5 compares the performance of the air classifier at three feed rates with a honeycomb-screen section in place. The decreasing effectiveness of the separation at high feed rates is due to the increasing downward distance over which the feed particles fall as a solid curtain, disrupting the air stream and preventing the air from acting on the particles individually.

As mentioned earlier, the amount of fines in any receiver section can be reduced, sharpening the separation, by feeding air into the bottom or sides of the receiver section to give a mean upward velocity in to the air in that section. The size of the particle affected by the air being so introduced is controlled by the magnitude of the mean upward air velocity.

Figure 6:
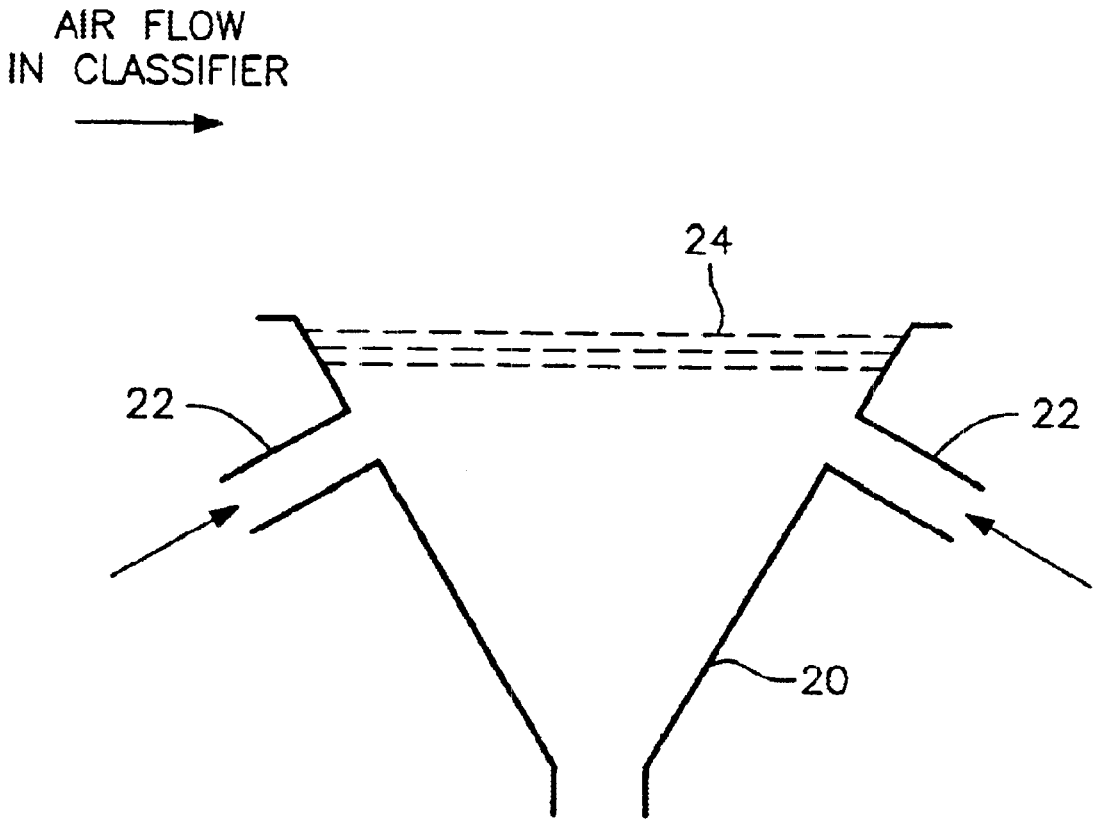
FIG. 6 illustrates an air inlet arrangement to a receiver section in accordance with the present invention.

FIG. 6 illustrates the position of two receiver air inlets 22 for the introduction of upward moving air into a receiver section 20. Also shown are screens 24 placed at the top of the receiver and above the receiver air inlets 22. Depending upon velocity, the air in these inlet streams to the receiver can introduce strong eddies; the screens 24 moderate the air flow, producing a more uniform upward velocity. The screen sections are designed in a manner similar to that used for the screen sections used for the air intake at the front of the main classifier. To avoid blockage of the receiver screens, the screen openings should be at least four times the diameter of the largest particle falling into the receiver.

Tables V and VI contain size distribution of receiver fraction data from classification runs made without air and with air being blown into receiver section G of the classifier, respectively. In both Tables V and VI, the classifier air velocity was 1.1 m/sec and the feed rate was 5 kg/min. The letter "T" is used to signify an amount of less than 0.1 gm. In the classification runs made with air being blown into the receiver section, summarized in Table VI, the air was introduced at a mean upward velocity which would affect particles up to roughly 120 microns, decreasing the number of such particles entering that receiver. As shown by the data, the upward air flow decreases the amount of the smallest particles (<75 microns) by roughly three-fold and the next larger fraction by nearly three-fold.

TABLE V

SIZE DISTRIBUTION OF RECEIVER FRACTIONS (%)
(NORMAL OPERATION)
Position Downstream from Feed Point

| Screen Fraction (microns) | A | B | C | D | E | F | G | H | I | J | FEED |
|---|---|---|---|---|---|---|---|---|---|---|---|
| >425 | | | 80 | 31 | 4 | 0 | 0 | 0 | 0 | 0 | 14 |
| 300–425 | | | 18 | 45 | 17 | T | 0 | 0 | 0 | 0 | 25 |
| 180–300 | | | 20 | 23 | 65 | 11 | 2 | T | T | 0 | 39 |
| 125–180 | | | T* | T | 12 | 72 | 25 | 7 | 3 | T | 10 |
| 75–125 | | | T | T | 01 | 14 | 57 | 58 | 33 | 3 | 3 |
| <75 | | | T | T | T | 2 | 16 | 34 | 64 | 96 | 9 |

TABLE VI

SIZE DISTRIBUTION OF RECEIVER FRACTIONS (%)
(IMPROVED SEDIMENTATION CONTROL)
Position Downstream from Feed Point

| Screen Fraction (microns) | A | B | C | D | E | F | G | H | I | J | FEED |
|---|---|---|---|---|---|---|---|---|---|---|---|
| >425 | | | 83 | 52 | 5 | 0 | 0 | 0 | 0 | 0 | 14 |
| 300–425 | | | 14 | 40 | 26 | T | T | 0 | 0 | 0 | 25 |
| 180–300 | | | 2 | 8 | 64 | 44 | 5 | 1 | 1 | T | 39 |
| 125–180 | | | T* | T | 4 | 49 | 69 | 44 | 12 | 1 | 10 |
| 75–125 | | | T | T | T | 6 | 21 | 48 | 65 | 17 | 3 |
| <75 | | | T | T | T | T | 5 | 7 | 21 | 82 | 9 |

Table VII and VIII contain similar data from classification runs made without air and with air being blown into receiver section E, respectively. In both Tables VII and VIII, the classifier air velocity was 1.1 m/sec and the feed rate was 5 kg/min. The letter "T" is used to signify an amount of less than 0.1 gm. As shown, the upward air flow reduces the amount of the fine particles in this receiver to traces.

TABLE VII

SIZE DISTRIBUTION OF RECEIVER FRACTIONS (%)
(NO AIR FLOW IN RECEIVERS)
Position Downstream from Feed Point

| Screen Fraction (microns) | A | B | C | D | E | F | C | H | I | J | FEED |
|---|---|---|---|---|---|---|---|---|---|---|---|
| >425 | | | 88 | 38 | 9 | T | T | 0 | 0 | 0 | 18 |
| 300–425 | | | 11 | 53 | 34 | T | T | T | 0 | 0 | 24 |
| 180–300 | | | T* | 8 | 53 | 44 | 3 | 1 | T | T | 36 |
| 125–180 | | | T | T | 2 | 52 | 65 | 25 | 6 | 1 | 10 |
| 75–125 | | | T | T | T | 2 | 12 | 28 | 18 | 2 | 3 |
| <75 | | | T | T | 1 | 2 | 19 | 45 | 75 | 96 | 9 |

TABLE VIII

SIZE DISTRIBUTION OF RECEIVER FRACTIONS (%)
(UPWARD AIR FLOW IN RECEIVER E)
Position Downstream from Feed Point

| Screen Fraction (microns) | A | B | C | D | E | F | G | H | I | J | FEED |
|---|---|---|---|---|---|---|---|---|---|---|---|
| >425 | | | 85 | 38 | 10 | 0 | 0 | 0 | 0 | 0 | 18 |
| 300–425 | | | 14 | 53 | 32 | T | 0 | 0 | 0 | 0 | 24 |
| 180–300 | | | T* | 8 | 57 | 53 | 5 | T | T | 0 | 36 |
| 125–180 | | | T | T | T | 43 | 69 | 18 | 4 | T | 10 |
| 75–125 | | | T | T | T | 1 | 13 | 28 | 23 | 2 | |
| <75 | | | T | T | T | 2 | 12 | 53 | 72 | 96 | |

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. An air classifier for particulate material comprising:

a substantially horizontally disposed classification chamber with an upstream end and a downstream end allowing air flow therethrough, an upper part and a lower part;

a feed stream input in the upper part proximate the upstream end of the chamber for feeding particulate matter from a source of such material into the chamber;

a plurality of receiver sections, serially disposed in an upstream to downstream arrangement in the lower part downstream of the feed stream input in the chamber;

an air suction device located proximate the downstream end of the chamber for creating a chamber air stream between the upstream and downstream ends thereof, said chamber air stream receiving and entraining particulate matter fed into the chamber through the feed stream input and carrying the particulate matter downstream to selectively deposit particles falling from the chamber air stream into one of the receiver sections; and an air inlet in at least one of said receiver sections providing an upwardly directed air stream through said at least one receiver section that keeps fines entrained in said chamber air stream and moving toward the downstream end.

2. The air classifier of claim 1, further including a screen section adjacent and upstream of the upstream end of the chamber whereby air drawn into the chamber by said suction device will pass through said screen section before engaging particulate material fed into the chamber through the feed stream input.

3. The air classifier of claim 2 wherein said screen section comprises from two to three screens.

4. The air classifier of claim 3 wherein said screens are formed from wire and succeeding screens are placed from 30 to 100 wire diameters apart.

5. The air classifier of claim 3 wherein said screens have a fraction of open area of between about 55 and 60 percent.

6. The air classifier of claim 3, wherein said screens are from 1 to 20 mesh.

7. The air classifier of claim 2 wherein said screen section comprises from two to three 1 to 20 mesh wire screens having a fraction of open area of between about 55 and 60 percent and succeeding screens are placed from about 30 to 100 wire diameters apart.

8. The air classifier of claim 2, further including a honeycomb adjacent and upstream of said screen section whereby air drawn into the chamber by said suction device will pass through said honeycomb and then said screen section before engaging the particulate material.

9. The air classifier of claim 8 wherein said honeycomb has a cell length to cell diameter ratio of about 4.

10. The air classifier of claim 1, further including a vibrating screen feeder interposed between the source of particulate material and the feed stream input to aid in separating particles as they are fed into the chamber.

11. The air classifier of claim 10 wherein said vibrating screen feeder has an amplitude of less than about 5 mm and a frequency of above about 3 cycles per second.

12. The air classifier of claim 10, wherein the screen of said vibrating screen feeder has openings at least three times larger than a diameter of a largest particle in the particulate matter.

13. The air classifier of claim 1, further including a receiver section screen above said air inlet in said at least one receiver section for moderating said upwardly directed air stream.

14. The air classifier of claim 1, wherein the volumetric air flow of said upwardly directed air stream is less than about one-third of the volumetric air flow of the chamber air stream.

15. The air classifier of claim 13, wherein screen openings in said at least one receiver section screen are at least four times a diameter of a largest particle falling into said at least one receiver section.

16. An air classifier device for particulate material comprising:

a horizontally disposed classification chamber having an upstream end, a downstream end, an upper part and a lower part, said upstream end and said downstream end allowing air flow therethrough;

air suction means located adjacent said downstream end of said chamber for drawing air through said chamber from said upstream end to create a chamber air stream;

a feed stream input in said upper part proximate said upstream end of said chamber for feeding particulate material into said chamber for entrainment in said chamber air stream, a vibrating screen feeder juxtaposed to said feed stream input having an amplitude of less than about 5 mm and a frequency of above about 3 cycles per second with openings at least about three times larger than the largest particle in the particulate material;

a screen section adjacent and upstream of said upstream end of said chamber and said feed stream input, said screen section comprising from two to three, 1–20 mesh, wire screens having a fraction of open area of between about 55 and 60 percent with succeeding screens placed from about 30 to 100 wire diameters apart;

a honeycomb adjacent to said screen section; and a plurality of receiver sections, serially disposed in an upstream to downstream arrangement in said lower part of said chamber, for collecting particles falling out of said chamber air stream, and an air inlet in at least one of the receiver sections for providing an upwardly directed air stream through said receiver section of a volumetric air flow less than about one-third of the volumetric air flow of said chamber air stream.

17. The air classifier of claim 16 wherein said honeycomb is upstream of said screen section whereby air drawn into said chamber by said suction means will pass through said honeycomb and then said screen section before engaging the particulate material.

18. An air classifier for particulate material comprising:

a substantially horizontally disposed classification chamber with an upstream end and a downstream end allowing air flow therethrough, an upper part and a lower part;

a feed stream input in the upper part proximate the upstream end of the chamber for feeding particulate matter from a source of such material into the chamber;

a screen section adjacent and upstream of said upstream end of said chamber and said feed stream input;

a honeycomb adjacent to said screen section;

an air suction device located proximate the downstream end of the chamber for creating a chamber air stream between the upstream and downstream ends thereof, said chamber air stream receiving and entraining particulate matter fed into the chamber through the feed stream input; and a plurality of receiver sections, serially disposed in an upstream to downstream arrangement in the lower part downstream of the feed stream input in the chamber, for collecting particles falling out of said chamber air stream, at least one of said receiver sections having an air inlet thereto that provides an upwardly directed air stream through said receiver section to keep fines entrained in said chamber air stream and moving toward the downstream end, and a receiver section screen for moderating said upwardly directed air stream.

19. The air classifier of claim 18, further comprising a vibrating screen feeder juxtaposed to said feed stream input with openings at least about three times larger than a largest particle in the particulate matter.

20. The air classifier of claim 18, wherein screen openings in said at least one receiver section screen are at least four times a diameter of a largest particle falling into said at least one receiver section.

* * * * *